US006561097B2

(12) United States Patent
Toyofuku

(10) Patent No.: US 6,561,097 B2
(45) Date of Patent: May 13, 2003

(54) SHEET MATERIAL POSITIONING METHOD AND APPARATUS

(75) Inventor: Takashi Toyofuku, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/808,013

(22) Filed: Mar. 15, 2001

(65) Prior Publication Data

US 2001/0022425 A1 Sep. 20, 2001

(30) Foreign Application Priority Data

Mar. 15, 2000 (JP) ..... 2000-073059

(51) Int. Cl.[7] ..... B41M 5/00
(52) U.S. Cl. ..... 101/481; 101/463.1; 101/DIG. 36
(58) Field of Search ..... 101/DIG. 36, 463.1, 101/481, 486; 33/621, 614, 617; 700/114; 356/394; 271/3.14

(56) References Cited

U.S. PATENT DOCUMENTS 5,255,607 A * 10/1993 Nishiyama et al. ..... 101/463.1
5,825,500 A * 10/1998 Iino et al. ..... 356/394
5,850,789 A * 12/1998 Rudolf et al. ..... 101/486
5,934,195 A * 8/1999 Rinke et al. ..... 101/401.1
6,072,896 A * 6/2000 Graves et al. ..... 382/135
6,115,654 A * 9/2000 Eid et al. ..... 701/34
6,354,208 B1 * 3/2002 Bos et al. ..... 101/463.1

* cited by examiner

*Primary Examiner*—Andrew H. Hirshfeld
*Assistant Examiner*—Dave A. Ghatt
(74) *Attorney, Agent, or Firm*—Sughrue Mion, PLLC

(57) ABSTRACT

In order to minimize the amount by which a sheet material must be moved for positioning, using a small number of sensors, and to achieve improvement of the operation and stabilization of the positioning accuracy, the size of the sheet material is recognized in advance, a sensor, which requires the smallest amount of movement of the sheet material for positioning the sheet material at a predetermined position, is selected from a plurality of sensors based on the recognized size, and the sheet material is detected by the selected sensor.

17 Claims, 12 Drawing Sheets

SHEET MATERIAL POSITIONING METHOD AND APPARATUS

BACKGROUND OF THE INVENTION

1. Field of the Invention

The present invention relates to a sheet material positioning method and apparatus, in which sheet materials having a plurality of sizes are conveyed in a predetermined conveying direction so as to be loaded onto a surface plate, and the sheet materials are positioned at a predetermined position on the surface plate.

2. Description of the Related Art

A technique has been developed, in which a printing plate (hereinafter a photopolymer plate) in which a photosensitive layer (e.g., a photopolymer layer) is provided on a support is used, and in which an image is directly recorded on the photopolymer layer of the photopolymer plate by laser beams or the like. (This technique is used in an automatic exposure apparatus for printing plates.)

In this technique, an image is rapidly recorded onto a photopolymer plate, and thus, photopolymer plates need to be sequentially sent. Accordingly, it is preferable that a plurality of photopolymer plates are stacked in advance at a predetermined position and ready to be used, and that the photopolymer plates are automatically taken out one by one so as to be sent into an exposure section. After being sent into the exposure section, the photopolymer plates are preferably conveyed along a predetermined proper conveying path.

The photopolymer plate needs to be wound onto a printing drum at the time of printing, and in order to position the photopolymer plate on the printing drum, an automatic exposure apparatus for printing plates includes a process for forming a punch-hole in the photopolymer plate. The punching is carried out on a surface plate, which serves as a base for the exposure of the photopolymer plate, and is also for the sub-scanning movement. And the punch-hole serves as reference at the time of exposure.

Accordingly, the photopolymer plate delivered onto the surface plate must be positioned at a proper position.

In order to carry out the positioning, initially, an incline of the photopolymer plate is corrected, parallelism of the punch-hole of the photopolymer plate for a center line is corrected. Then, a direction of the photopolymer plate, in which the punch-hole is orthogonal to the center line, is determined based on inversion of output signals from a plurality of sensors (inversion from a photopolymer plate detected state to a photopolymer plate undetected state, or inversion from the undetected state to the detected state), which sensors are provided at positions, which are the corners of the photopolymer plate when the photopolymer plate is at the proper position. Namely, the incline of the photopolymer plate with respect to the center line of the surface plate on the surface plate is corrected, and the position of the photopolymer plate on the surface plate in a direction which is orthogonal to the center line is corrected by using the sensors.

However, the side of the photopolymer plate, which side is in the direction orthogonal to the center line, may have various sizes which are within a range from 400 mm to 745 mm in millimeter interval. Thus, if sensors are provided so as to be at the best position for the each of respective sizes of the photopolymer plates, an enormous number of sensors are required. Therefore, a predetermined number of sensors are disposed at predetermined positions within the above-described range (the predetermined number is a number which is fewer than the number of sizes of the photopolymer plates). The positioning of the photopolymer plate is carried out on the basis of a calculation result from detection results by the sensor. If the sensors are disposed at random positions in this way, the amount of movement for initially detecting a corner of the photopolymer plate by the sensor and the amount of movement obtained by the computations for positioning the photopolymer plate at the appropriate position vary depending upon the size of the photopolymer plate. As a result, there are disadvantages that, for example, the operation efficiency deteriorates, and the positioning accuracy varies depending upon the size of the photopolymer plate.

SUMMARY OF THE INVENTION

In consideration of the above facts, it is an object of the present invention to obtain a sheet material positioning method and apparatus, in which, positioning is carried out by a small number of sensors and at the time of positioning the sheet material, amount of movement for positioning can be minimized, and in which, improvement of the operation and stabilization of the positioning accuracy can be archived.

A first aspect of the present invention is a sheet material positioning method, in which, sheet materials having a plurality of sizes are conveyed in a predetermined conveying direction so as to be loaded onto a surface plate, and an incline and a position of the sheet material in a conveying direction of the sheet material with respect to a proper position are corrected, and the sheet material, whose incline and position with respect to the proper position have been corrected, is positioned at a predetermined position on the surface plate by being moved in a direction orthogonal to the conveying direction, by using a plurality of sensors for detecting at least one corner of the sheet material; and wherein at least one dimension of the sheet material in the direction orthogonal to the conveying direction has been recognized in advance; and wherein a sensor, which requires the smallest amount of movement of the sheet material for positioning the sheet material at the predetermined position, is selected from the plurality of sensors based on the recognized dimension of the sheet material, and the corner of the sheet material is detected by the selected sensor.

According to the first aspect of the present invention, with respect to the proper position, after the incline has been eliminated and the positioning in the conveying direction of the sheet material has been corrected, the sensor, which requires the smallest amount of movement of the sheet material for positioning, is selected based on the dimension of the sheet material. As a result, the time for positioning the sheet material can be shortened.

A second aspect of the present invention according to the first aspect is a sheet material positioning method, wherein, after the sheet material has been loaded onto the surface plate, a pressing member, which has a portion that is parallel to a side of the sheet material which side is orthogonal to the conveying direction, presses the sheet material to the proper position, so that the incline and the position in the conveying direction of the sheet material are corrected simultaneously.

According to the second aspect of the present invention, with respect to the proper position, the incline is eliminated and the positioning in the conveying direction of the sheet material is corrected in the following manner: After the sheet material has been loaded onto the surface plate, a pressing member, which has a line connecting at least two points, which line is parallel to a side of the sheet material which side is orthogonal to the conveying direction, is moved to the predetermined position, so that the incline and the positioning in the conveying direction of the sheet material are corrected simultaneously. In this way, the position of the side of the sheet material pressed by the pressing member is fixed, and thus, the sheet material can be easily positioned in the conveying direction thereof. However, since positioning of the sheet material in the direction which is orthogonal to the conveying direction on the basis of a center reference, if the size of the sheet material varies, the position of the sheet material in the direction which is orthogonal to the conveying direction respectively varies. As a result, the positioning method described in the first aspect is required, and the smaller the amount of movement of the sheet material for positioning, the shorter the time for positioning.

A third aspect of the present invention according to the first or second aspect is a sheet material positioning method, wherein the dimension of the sheet material in the direction orthogonal to the conveying direction has different values, the different values are on the basis of a predetermined dimension of 10 mm or lower.

According to the third aspect of the present invention, the sheet material has a number of different sizes, and thus, it is almost impossible in a structural view to dispose sensors optimal for detecting the respective corners of the sheet materials for each of the sizes. Therefore, for example, the smallest and the largest sheet materials are selected, and the sensors are disposed so as to be most suitable only for the selected sheet materials. When the sheet material is of another size, after the corner thereof has been detected by one of the disposed sensors, the difference can be computed so that the sheet material is conveyed.

A fourth aspect of the present invention is a sheet material positioning apparatus, in which, sheet materials having a plurality of sizes are conveyed in a predetermined conveying direction so as to be loaded onto a surface plate, and the sheet material is positioned at a predetermined position on the surface plate, the apparatus comprising: a correcting device, which corrects an incline and a position in the conveying direction of the sheet material with respect to a proper position; a plurality of sensors, which detect at least one corner of the sheet material by movement of the sheet material in a direction orthogonal to the conveying direction; a storing device, which stores at least one dimension of the sheet material in the direction orthogonal to the conveying direction in advance; a selecting device, which, based on the dimension stored in the storing device, selects a sensor from the plurality of sensors, that requires the smallest amount of movement of the sheet material for positioning the sheet material at the predetermined position; and a movement controlling device, which moves the sheet material in the direction orthogonal to the conveying direction based on the sensor selected by the selecting device, and which stops the movement of the sheet material in the direction orthogonal to the conveying direction when the sensor has detected the corner of the sheet material.

According to the fourth aspect of the present invention, initially, the incline and the position in the conveying direction of the sheet material with respect to the proper position are corrected by the correcting device. Next, the sensor, that requires the smallest amount of movement of the sheet material for positioning it at the predetermined position, is selected from the plurality of sensors by the selecting device based on the dimension stored in the storing device. After that, by the movement controlling device, the sheet material is moved in the direction orthogonal to the conveying direction using the sensor selected by the selecting device, and the movement of the sheet material in the direction orthogonal to the conveying direction is stopped when the sensor has detected the corner of the sheet material.

In other words, since the size (dimension) of the conveyed sheet material has been stored in the storing device in advance, which of the plurality of sensors is most suitable can be reliably determined. When the sensor is selected based on the determination, the sensor, that requires the smallest amount of movement of the sheet material for positioning, is reliably selected.

A fifth aspect of the present invention according to the fourth aspect is a sheet material positioning apparatus, wherein, the correcting device is formed of a pressing member, which has a portion that is parallel to a side of the sheet material which side is orthogonal to the conveying direction, and wherein, after the sheet material has been loaded onto the surface plate, the pressing member presses the sheet material to the proper position, so that the incline and the position in the conveying direction of the sheet material are corrected simultaneously.

According to the fifth aspect of the present invention, with respect to the proper position, the incline has been eliminated and the position in the conveying direction of the sheet material is corrected in the following manner: After the sheet material has been loaded onto the surface plate, a pressing member, which has a line connecting at least two points, which line is parallel to a side of the sheet material which side is orthogonal to the conveying direction, is moved to the predetermined position, so that the incline and the position in the conveying direction of the sheet material are corrected simultaneously. In this way, the position of the side of the sheet material pressed by the pressing member is fixed, and thus, the position in the conveying direction of the sheet material can be easily positioned.

A sixth aspect of the present invention according to the fourth or fifth aspect is a sheet material positioning apparatus, wherein the dimension of the sheet material in the direction orthogonal to the conveying direction has different values, the different values are on the basis of a predetermined dimension of 10 mm or lower.

According to the sixth aspect of the present invention, the sheet material has a number of different sizes, and thus, it is almost impossible in a structural view that the sensors are arranged so as to be most suitable for detecting the respective corners of the sheet materials. Therefore, for example, the smallest and the largest sheet materials are selected, and the sensors are disposed so as to be most suitable only for the selected sheet materials. When the sheet material is of another size, after the corner thereof has been detected by one of the disposed sensors, the difference can be computed so that the sheet material is conveyed.

A seventh aspect of the present invention according to any one of the fourth to sixth aspects is a sheet material positioning apparatus, wherein the plurality of sensors include two sensors, which are disposed at positions corresponding to dimensions of smallest and largest sheet materials in the direction orthogonal to the conveying direction.

According to the seventh aspect of the present invention, when at least two sensors, which correspond to the smallest and the largest sheet materials, are disposed, the sheet material can be positioned by being moved by an amount which is smaller than the difference between the smallest and the largest sheet materials (smaller than a distance on the basis of the difference between the smallest and the largest sheet materials).

An eighth aspect of the present invention according to any one of the fourth to sixth aspects is a sheet material positioning apparatus, wherein the plurality of sensors include three sensors, two sensors of which are disposed at positions corresponding to dimensions of smallest and largest sheet materials in the direction orthogonal to the conveying direction, and one sensor other than the two sensors is disposed at a position in substantially middle of the two sensors.

According to the eighth aspect of the present invention, in addition to the seventh aspect, the sensor is added so as to correspond to a medium-sized sheet material whose size is between that of the smallest and the largest ones. As a result, the amount of movement for positioning can be reduced, and further, for example, if the sensor at the middle position is made movable, the sensor can be disposed in accordance with the size of the sheet material which is frequently used by the applied user.

A ninth aspect of the present invention according to any one of the fourth to sixth aspects is a sheet material positioning apparatus, wherein the plurality of sensors include CCD line sensors.

According to the ninth aspect of the present invention, when the CCD line sensors are disposed at predetermined positions, the position of the sheet material can be accurately recognized. Further, the plurality of sensors may be closely arranged so as to form a group of sensors.

A tenth aspect of the present invention according to any one of the fourth to ninth aspects is a sheet material positioning apparatus, wherein the sheet material is a printing plate in which a photosensitive layer is provided on a support.

According to the tenth aspect of the present invention, the printing plate in which the photosensitive layer is provided on the support is used as the sheet material. The printing plate is photosensitive, and thus, it needs to be positioned in a darkroom. Accordingly, automatic positioning by the sensors is necessary. In this case, the positioning apparatus described in the fourth to ninth aspects is effective.

An eleventh aspect of the present invention according to the tenth aspect is a sheet material positioning apparatus, wherein, in a state in which the printing plate is positioned at the predetermined position, a punch-hole for positioning the printing plate at a mounting position on a printing drum is formed in the printing plate.

According to the eleventh aspect of the present invention, in order to form the punch-hole in the printing plate for positioning the printing plate at the mounting position on the printing drum, the positioning needs to be accurately carried out. If the punch-hole is dislocated, color blurring or the like is caused, and as a result, the image quality is deteriorates. Accordingly, the invention described in the tenth aspect, in which both positioning rapidity and positioning accuracy can be archived, is effective.

A twelfth aspect of the present invention is a sheet material positioning method, in which, a sheet material is conveyed in a predetermined conveying direction so as to be loaded onto a surface plate, and the sheet material loaded onto the surface plate is moved in a direction orthogonal to the conveying direction, such that the sheet material is positioned at a predetermined position on the surface plate by a plurality of sensors for detecting the sheet material; and wherein at least one dimension of the sheet material in the direction orthogonal to the conveying direction is recognized; and wherein a sensor, which requires the smallest amount of movement of the sheet material for positioning the sheet material at the predetermined position, is selected from the plurality of sensors based on the recognized dimension of the sheet material, and the sheet material is detected by the selected sensor.

A thirteenth aspect of the present invention according to the twelfth aspect is a sheet material positioning method, wherein, before the sheet material loaded onto the surface plate is moved in the direction orthogonal to the conveying direction, the orientation and position of the sheet material are corrected so that the sheet material has a predetermined orientation with respect to the conveying direction and the sheet material is positioned at a predetermined position in the conveying direction.

A fourteenth aspect of the present invention according to the twelfth aspect is a sheet material positioning method, wherein the corner of the sheet material is detected by the selected sensor.

A fifteenth aspect of the present invention is a sheet material positioning apparatus, in which, a sheet material is conveyed in a predetermined conveying direction so as to be loaded onto a surface plate, and the sheet material loaded onto the surface plate is moved in a direction orthogonal to the conveying direction, such that the sheet material is positioned at a predetermined position on the surface plate by a plurality of sensors for detecting the sheet material, the apparatus comprising: a recognizing portion, which recognizes at least one dimension of the sheet material in the direction orthogonal to the conveying direction; and a selecting portion, which, based on the dimension of the sheet material recognized by the recognizing portion, selects a sensor from the plurality of sensors, which requires the smallest amount of movement of the sheet material for positioning the sheet material at the predetermined position; and wherein the sheet material is detected by the selected sensor.

A sixteenth aspect of the present invention according to the fifteenth aspect is a sheet material positioning apparatus, wherein the corner of the sheet material is detected by the selected sensor.

A seventeenth aspect of the present invention according to the fifteenth aspect is a sheet material positioning apparatus further comprising a storing device, which stores the dimension of the sheet material recognized by the recognizing portion.

DESCRIPTION OF THE PREFERRED EMBODIMENT (Overall Structure)

Figure 1:
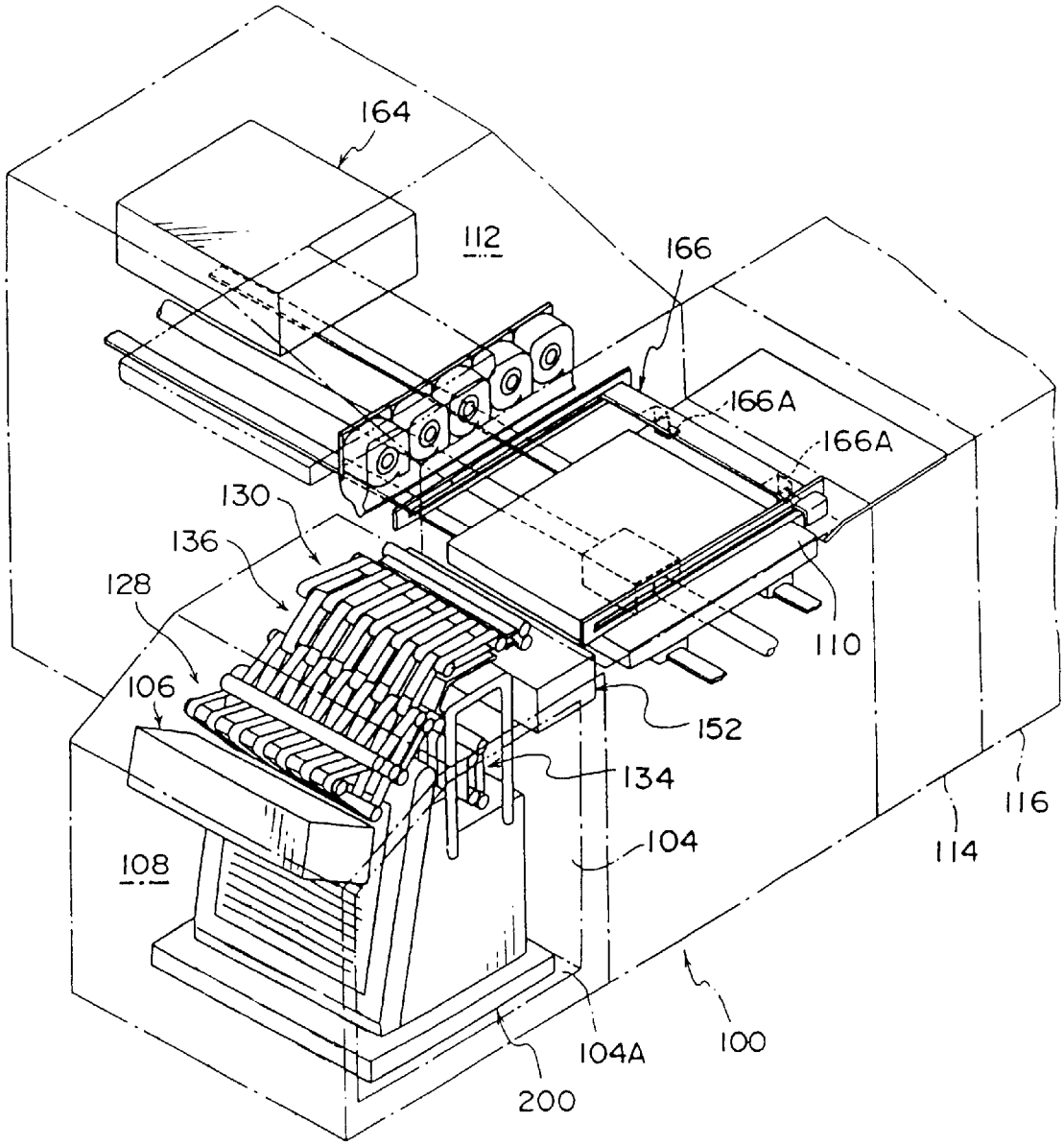
FIG. 1 is a perspective view showing an overall structure of an automatic exposure apparatus relating to the present embodiment.

An automatic exposure apparatus 100 for photopolymer plates, which apparatus relates to this embodiment, is shown in FIG. 1.

The automatic exposure apparatus 100 consists of a plate supplying section 108, which includes a plate accommodating portion 104 that accommodates photopolymer plates 102 (see FIG. 2) loaded on a trolley 200, and includes a sheet feeding portion 106 that carries out the photopolymer plate 102 accommodated in the plate accommodating portion 104; a surface plate 110 on which the photopolymer plate 102 is positioned and held; and an exposure section 112 which records an image on the photopolymer plate 102 positioned on the surface plate 110.

An automatic developing apparatus 116 can be provided at a downstream side of the automatic exposure apparatus 100 via a buffer portion 114. Thus, all of the plate-supplying, exposing and developing processes can be automatically carried out.

Figure 2:
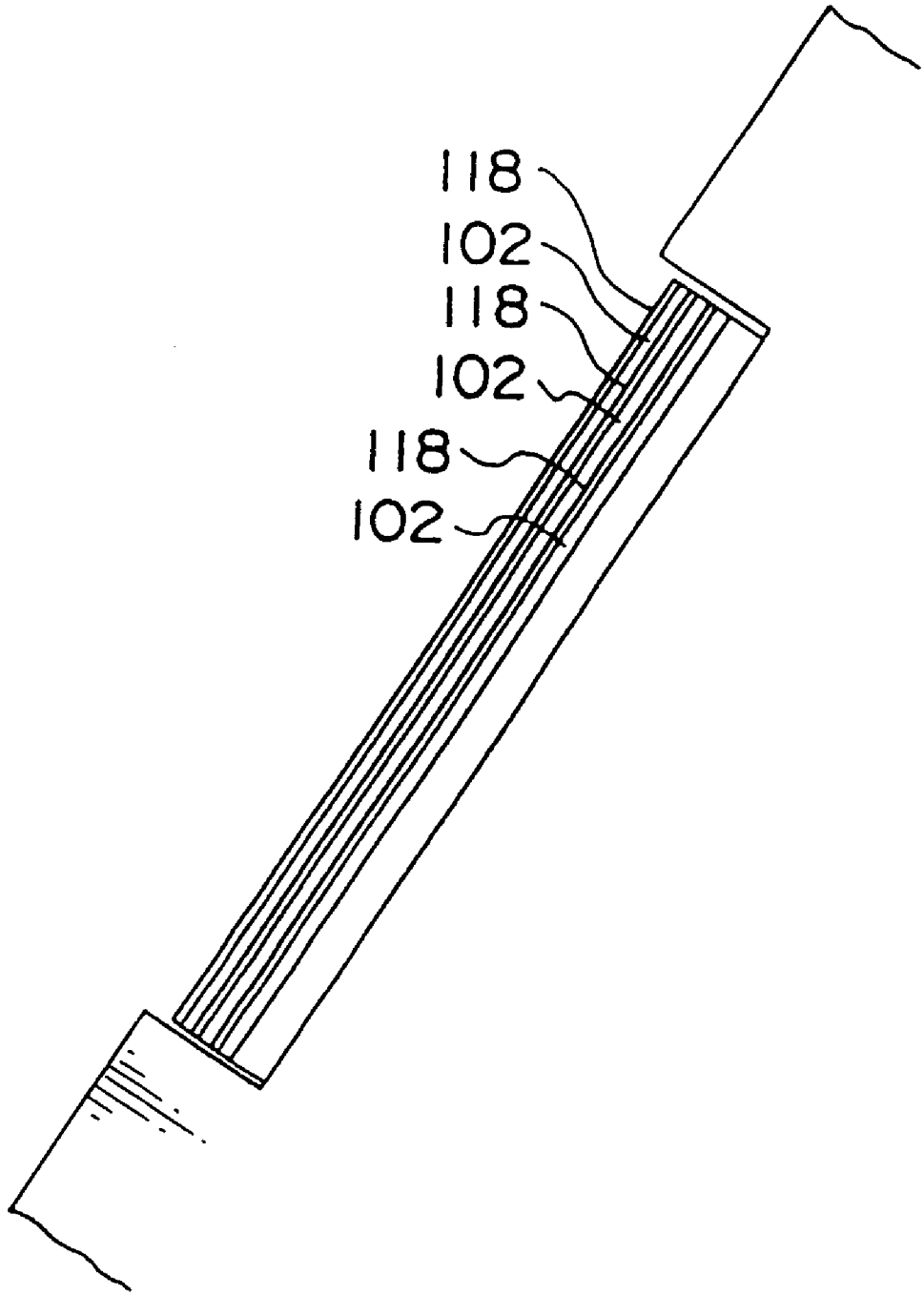
FIG. 2 is a side view showing a state in which photopolymer plates and interleaf sheets are loaded in a magazine.
Figure 3:
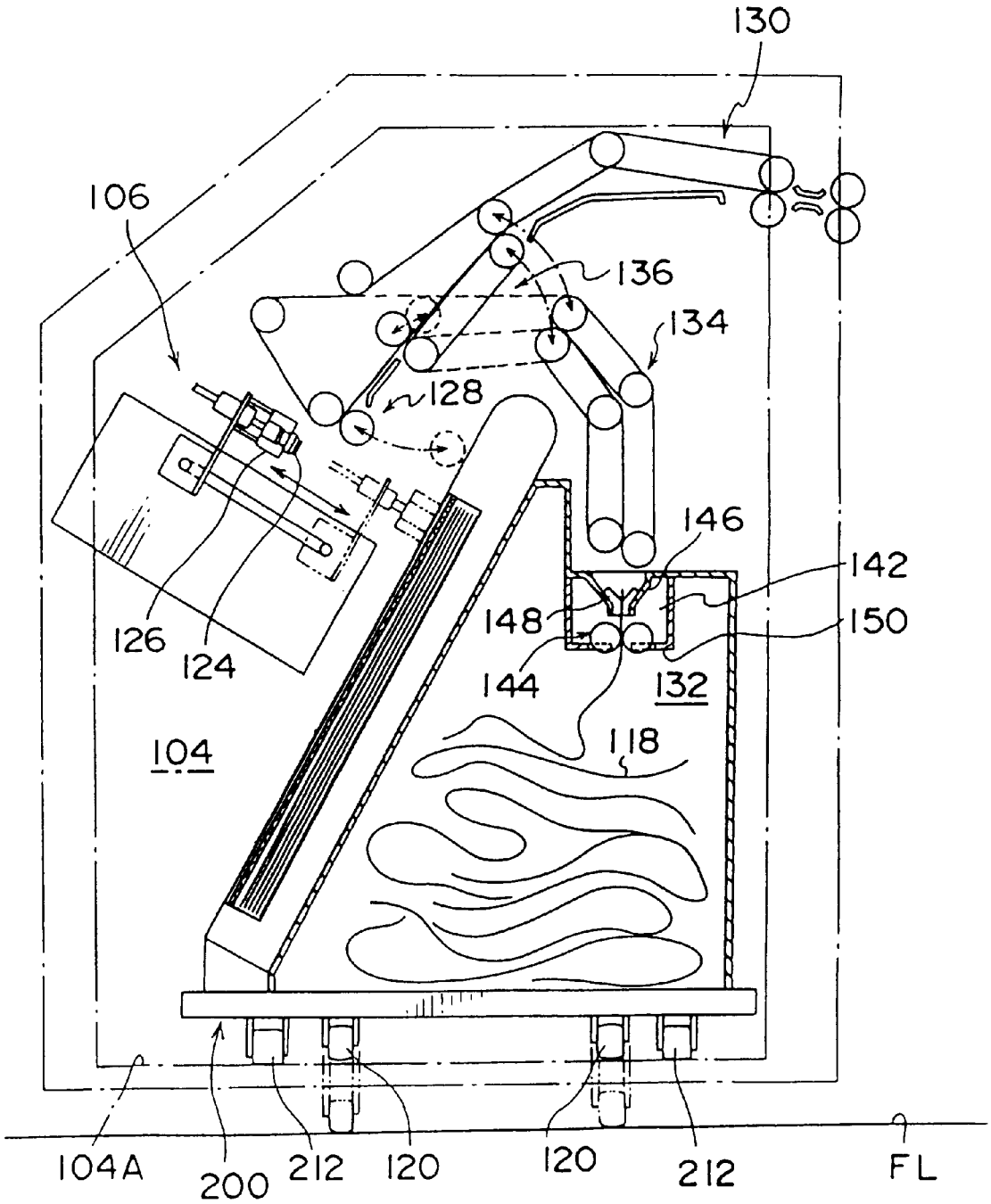
FIG. 3 is a side view of a plate supplying section.

As shown in FIG. 3, the plate accommodating portion 104 can accommodate the trolley 200 against which a plurality of photopolymer plates 102 are propped. As shown in FIG. 2, a protective interleaf sheet 118 is provided on a surface of each photopolymer plate 102, and as a result, the photopolymer plates 102 and the interleaf sheets 118 are alternately superimposed.

The plate accommodating portion 104 forms a floor portion 104A at a higher position than a ground surface, and the trolley 200 is structured so that it can be mounted onto the floor portion 104A from the ground surface. Specifically, the trolley 200 is supported to the ground surface via casters 120, and each of the casters 120 can move to protruding positions (i.e., the positions shown with notched lines in FIG. 3) or to storing positions (i.e., the positions shown with solid lines in FIG. 3) with respect to the trolley 200.

At the same time when the casters 120 move to the storing positions so as to be upwardly collapsed toward the plate accommodating portion 104 due to a storing operation, auxiliary rollers 212 correspond to the floor portion 104A. Thereafter, the trolley 200 is supported to the floor portion 104A via the auxiliary rollers 212.

The sheet feeding portion 106 is provided above the plate accommodating portion 104. The sheet feeding portion 106 is structured so as to alternately take up the photopolymer plate 102 and the interleaf sheet 118 from a state in which they are stacked, and send them to a common conveying portion 128. The sheet feeding portion 106 includes a sucker 124, which sucks the photopolymer plate 102 and the interleaf sheet 118. Further, a suction fan 126 is separately provided near the sucker 124, as an auxiliary means for sucking the interleaf sheet 118. The sucker 124 and the suction fan 126 can move integrally toward and away from a surface of an interleaf sheet 118 or of a photopolymer plate 102, which are stacked together.

When the photopolymer plate 102 is sucked and held, the sucker 124 is disposed so as to be in contact with the photopolymer plate 102. On the other hand, when the interleaf sheet 118 is sucked and held, the suction fan 126 is disposed so as to be slightly away from (or may be disposed so as to be in contact with) the interleaf sheet 118, and only the suction fan 126 is operated. The suction fan 126 sucks up only the interleaf sheet 118 which is lighter and thinner than the photopolymer plate 102, and thereafter, the sucker 124 sucks the interleaf sheet 118. As a result, when the interleaf sheet 118 is sucked, double suction (i.e., suction of the interleaf sheet 118 together with the underlying photopolymer plate 102) is prevented.

The plate supplying section 108 largely consists of the common conveying portion 128, which receives the photopolymer plate 102 or the interleaf sheet 118 from the sheet feeding portion 106 and conveys it; a photopolymer plate conveying portion 130, which receives the photopolymer plate 102 and sends it to the surface plate 110; an interleaf sheet conveying portion 134, which receives the interleaf sheet 118 and sends it to an interleaf sheet accommodating portion 132 (loaded on the trolley 200); and a conveyance switch portion 136, which guides the photopolymer plate 102 or the interleaf sheet 118 from the common conveying portion 128 to either the photopolymer plate conveying portion 130 or the interleaf sheet conveying portion 134 by a switching operation.

Specifically, as the photopolymer plates 102 and the interleaf sheets 118 are alternately stacked, each time the photopolymer plate 102 or the interleaf sheet 118 is sucked at the sheet feeding portion 106, the conveyance switch portion 136 switches and conveys the photopolymer plate 102 or the interleaf sheet 118 to the respective predetermined direction.

Figure 4A:
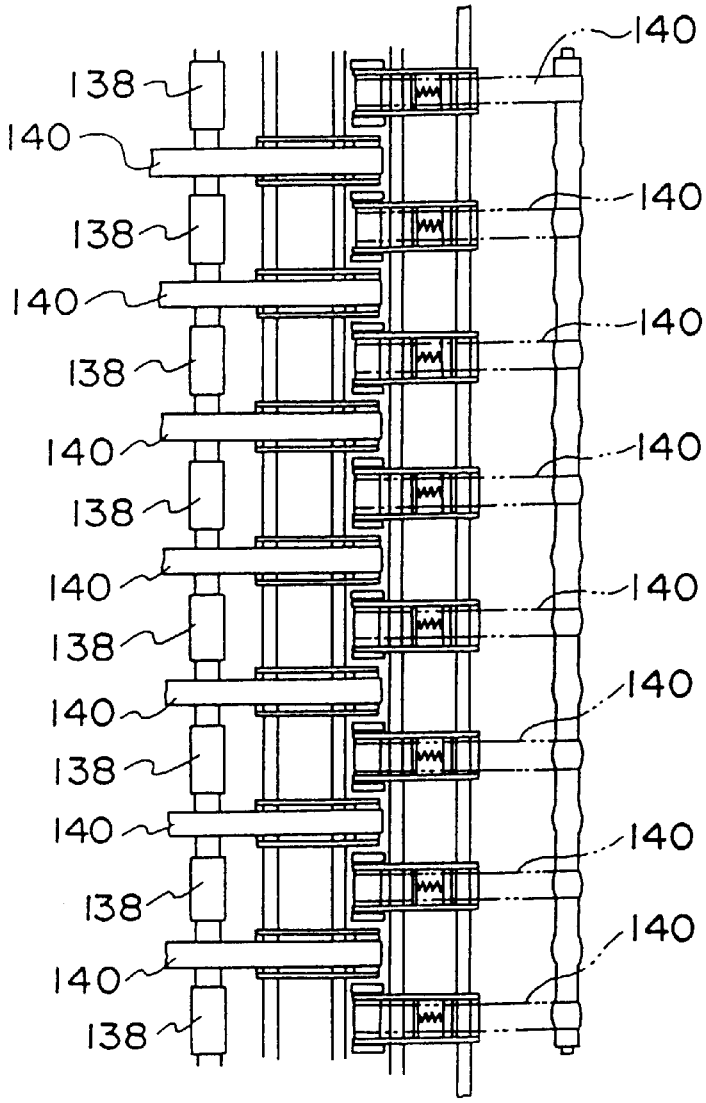
FIG. 4A is a plan view showing a portion of a conveying system of the plate supplying section.
Figure 4B:
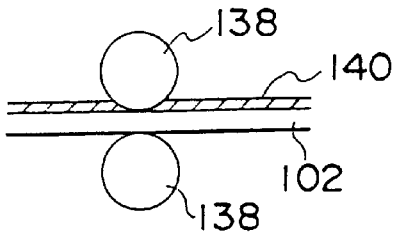
FIG. 4B is a side view showing a portion of the conveying system of the plate supplying section.

As shown in FIG. 4A, the common conveying portion 128, the photopolymer plate conveying portion 130 and the conveyance switch portion 136 are a conveying system in which skewered rollers 138 and narrow belts 140 are combined, and this conveying system is formed so as to mainly convey the photopolymer plate 102 (see FIG. 4B). Specifically, the photopolymer plate 102 is conveyed with a strong nipping force of the skewered rollers 138, and the narrow belts 140 serve as guide panels which move synchronously with the conveyance.

Figure 4C:
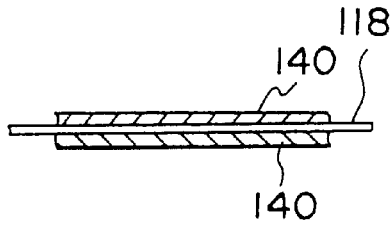
FIG. 4C is a side view of an essential portion of an interleaf sheet conveying portion.

On the other hand, as shown in FIG. 4C, the interleaf sheet conveying portion 134 is a conveying system including only the narrow belts 140. This conveying system is structured so as to convey the interleaf sheet 118 with a weak nipping force of the narrow belts 140.

Figure 5:
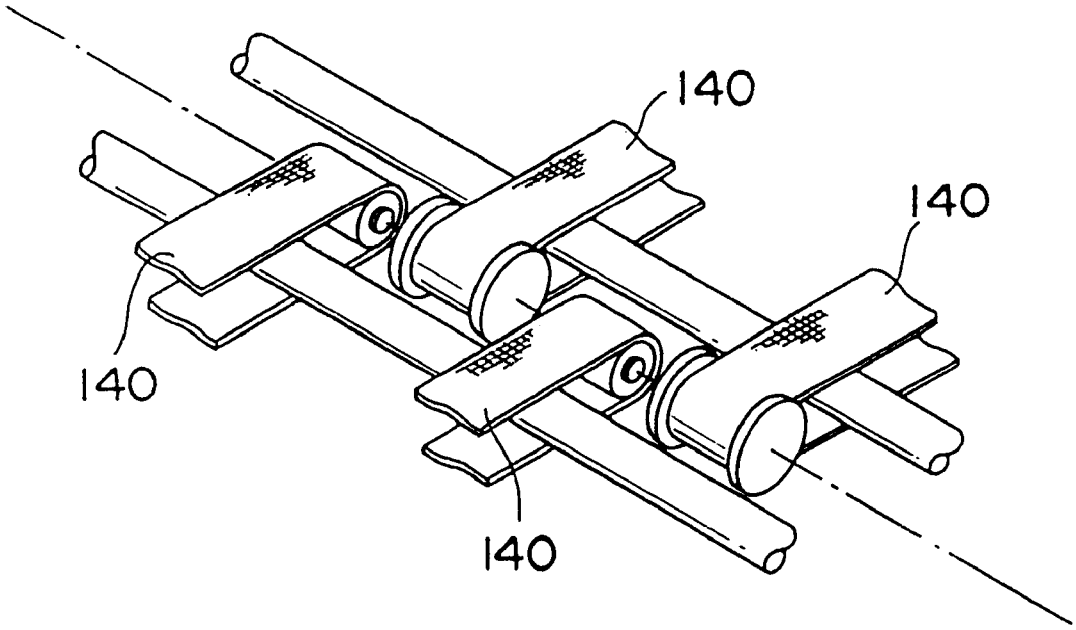
FIG. 5 is a perspective view showing a delivery portion for passing the printing plates between different conveying systems of the plate supplying section.

As shown in FIG. 5, at a portion for delivery from one conveying portion to another, end portions thereof alternately protrude in a skewered configuration, such that a recessed end portion of one corresponds to a protruded end portion of the other (i.e., both end portions have a coaxial common conveying path). As a result, when the photopolymer plate 102 and the interleaf sheet 118 are delivered, they are prevented from being caught in the skewered rollers 138 and the narrow belts 140.

As shown in FIG. 3, the interleaf sheet 118 conveyed by the interleaf sheet conveying portion 134 is guided to the interleaf sheet accommodating portion 132 provided on the trolley 200. An insertion opening 142 for the interleaf sheets 118, which is provided at an upper portion of the interleaf sheet accommodating portion 132, is provided with a pair of rollers 144. The rollers 144 drive rotatively at a linear velocity, which is slightly higher (about 1.1 times) than the conveyance velocity of the interleaf sheet conveying portion 134. Accordingly, when the interleaf sheet 118 is between the interleaf sheet conveying portion 134 and the rollers 144, the interleaf sheet 118 is conveyed while maintaining a predetermined tense state. As a result, jamming resulting from slackness and the like is prevented.

Tapered guide panels 146, by which the width (in the thickness direction of the interleaf sheet 118) is gradually narrowed, are provided at an upstream side of the insertion opening 142. A charge removing brush 148 is attached to each of the tapered guide panels 146 which oppose each other, and the charge removing brushes 148 remove charge from the interleaf sheet 118 inserted into the insertion opening 142.

The pair of rollers 144 are arranged in a skewered configuration, and partition panels 150 are provided along the protruding portions which result from the skewered configuration. As a result, even if a part of the interleaf sheet 118, which has been accommodated in the interleaf sheet accommodating portion 132, touches the rollers 144, the partition panels 150 prevent the interleaf sheet 118 from being caught in the rollers 144.

As shown in FIG. 1, the photopolymer plate 102 conveyed by the photopolymer plate conveying portion 130 leaves the photopolymer plate conveying portion 130 in a horizontal conveyance state, and is delivered to the surface plate 110.

Figure 6A:
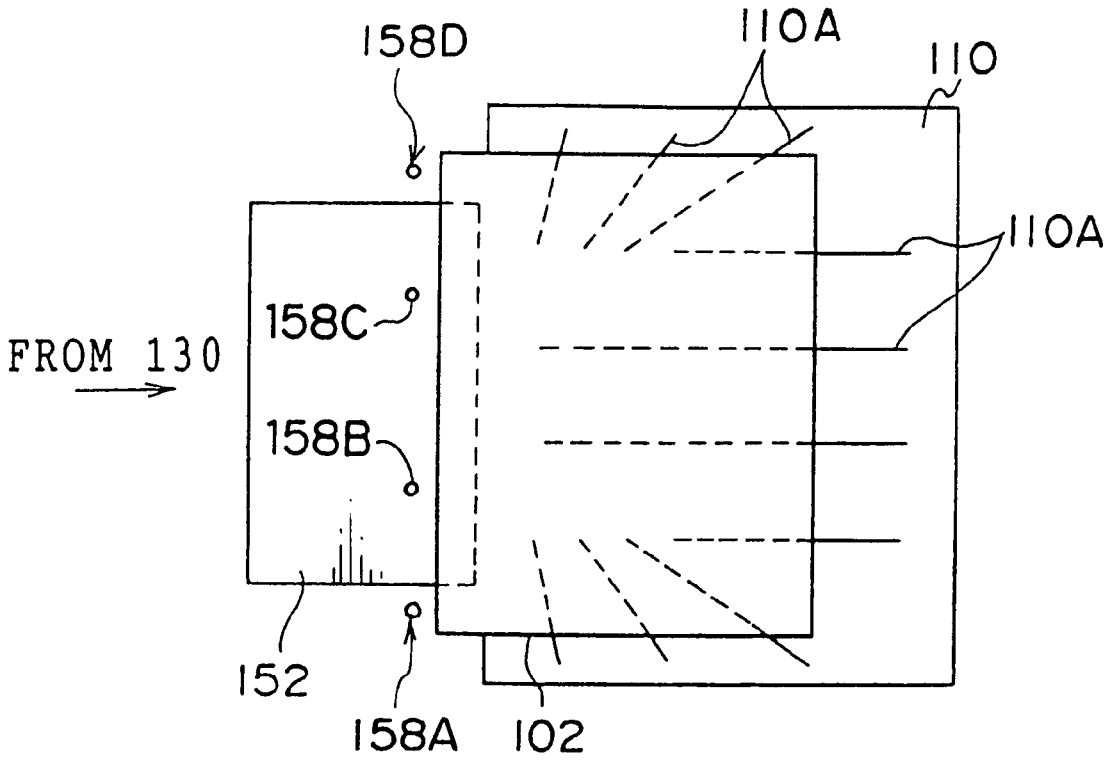
FIG. 6A is a plan view of a surface plate.
Figure 6B:
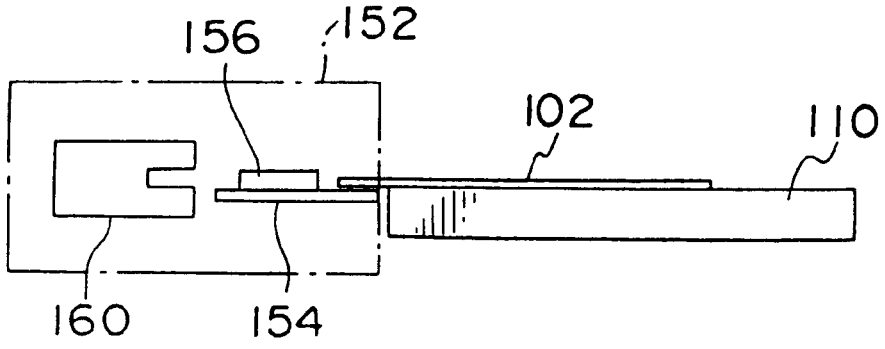
FIG. 6B is a side view of the surface plate.

A height of a top surface of the surface plate 110 is lower than a horizontal conveyance height of the photopolymer plate conveying portion 130, and there is a slight gap therebetween in the conveying direction. Accordingly, when the photopolymer plate 102 is discharged from the photopolymer plate conveying portion 130, the photopolymer plate 102 lands on the surface plate 110 in a state in which it hangs slightly, and a rear end portion of the photopolymer plate 102 in the conveying direction is positioned at a more upstream position than the surface plate 110. As shown in FIG. 6B, a temporary support plate 154, which is provided on a moving body 152 that can move toward and away from the surface plate 110, is disposed at this upstream position, and the temporary support plate 154 prevents the photopolymer plate 102 from hanging.

A pressing plate 156 for pressing the rear end portion of the photopolymer plate 102 in the conveying direction is provided at a part of the temporary support plate 154. When the rear end portion of the photopolymer plate 102 is pressed by the pressing plate 156, the incline of the photopolymer plate 102 is eliminated, and the photopolymer plate 102 can be sent to a predetermined reference position in the conveying direction. When the photopolymer plate 102 is at the reference position, the rear end portion thereof in the conveying direction slightly juts out from the surface plate 110.

In the reference position, sensors 158 are provided at a plurality of positions including both corners of the rear end portion of the photopolymer plate 102 in the conveying direction. When the rear end portion of the photopolymer plate 102 in the conveying direction is detected by the sensors 158, the pressing of the pressing plate 156 is discontinued. Further, the sensors 158 are also applied for detecting the position of the photopolymer plate 102 in the transverse direction of conveyance. Specifically, the corners of the photopolymer plate 102 are adjusted so as to be in line with the sensors 158 by movement of the surface plate 110 in the transverse direction of conveyance, and the detected position is registered as a start position of the photopolymer plate 102.

The position of the photopolymer plate 102 moved to the start position is determined relative to a starting position of scanning exposure at the exposure section 112. The photopolymer plate 102 is sucked and held in this state by suction grooves 110A (see FIG. 6A) provided at the surface plate 110.

A punch-hole is formed in the photopolymer plate 102 which is sucked and held, by a puncher 160 (see FIG. 6B) provided on the moving body 152.

The surface plate 110 can move back and forth at a uniform velocity between a first position (see the position shown with solid lines in FIG. 1), at which the photopolymer plate 102 is received from the photopolymer plate conveying portion 130, and a second position (see the position shown with notched lines in FIG. 1), at which the photopolymer plate 102 is accommodated in the exposure section 112. (Movement in the transverse direction of the conveyance for positioning also takes place in this back and forth manner.) At the exposure section 112, a scanning unit 164 is provided above the conveying path of the surface plate 110. In the scanning unit 164, laser beams which are light-controlled in accordance with image signals are primarily scanned (in the direction orthogonal to the conveying direction of the surface plate 110). On the other hand, forward conveyance of the surface plate 110 is a movement for secondary scanning. As a result, an image is recorded onto the photopolymer plate 102 on the surface plate 110 during the forward conveyance to the exposure section 112, and then, the photopolymer plate 102 is returned to the original position by return conveyance. The photopolymer plate 102 on the surface plate 110, which has been returned to the original position, is released from the state of being sucked and held.

Figure 7A:
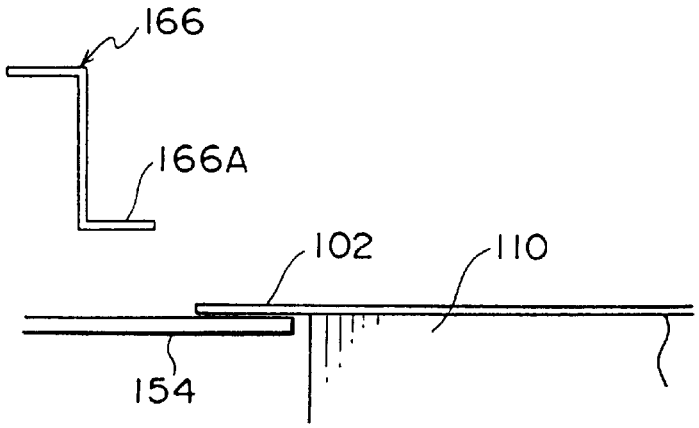
FIG. 7A is a side view showing an operation of a discharging mechanism portion at the beginning thereof.

When the image has been recorded on the photopolymer plate 102 and the surface plate 110 has been returned to the original position, a discharging mechanism portion 166, which has been on standby at the rear end portion side of the photopolymer plate 102 in the direction that the plate is conveyed by the photopolymer plate conveying portion 130, passes over the surface plate 110 so as to move to a front end portion side of the photopolymer plate 102 in the conveying direction (see FIG. 7A).

Figure 7B:
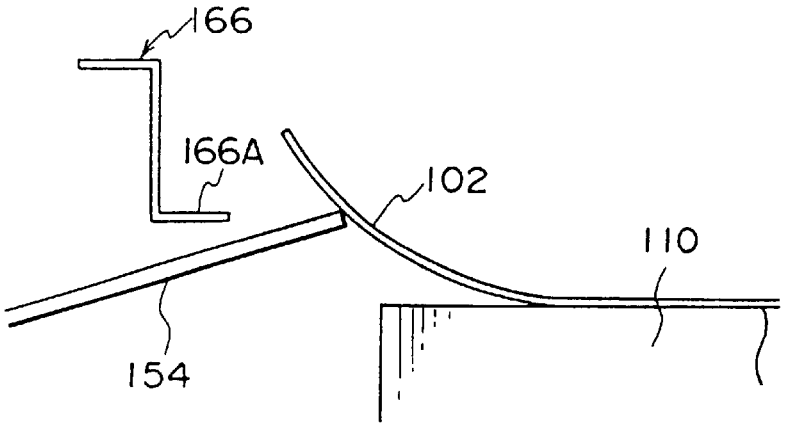
FIG. 7B is a side view showing an operation of the discharging mechanism portion in a state in which the photopolymer plate is lifted up.
Figure 7C:
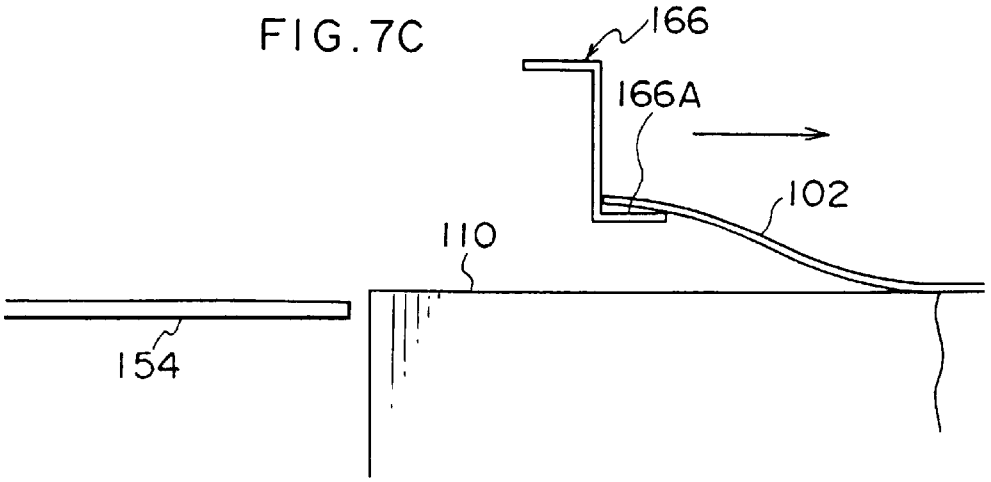
FIG. 7C is a side view showing an operation of the discharging mechanism portion at the time of discharging the photopolymer plate.

Hook portions 166A for loading the rear end portion of the photopolymer plate 102 in the conveying direction are formed at the discharging mechanism portion 166. The rear end portion of the photopolymer plate 102 which juts out from the surface plate 110 is lifted up by the temporary support plate 154 provided on the moving body 152 (see FIG. 7B), and the discharging mechanism portion 166 is moved in the direction that the photopolymer plate 102 is conveyed. As a result, the photopolymer plate 102 is engaged with the hook portions 166A, and while the discharging mechanism portion 166 is moved, the photopolymer plate 102 is conveyed to a downstream side of the surface plate 110 (see FIG. 7C). The buffer portion 114 and further the automatic developing apparatus 116 are provided at this downstream side. While the difference between a discharging speed at the discharging mechanism portion 166 and a conveying speed at the automatic developing apparatus 116 is absorbed by the buffer portion 114, the photopolymer plate 102 is smoothly sent out.

(Arrangement Structure of Sensors)

Figure 8:
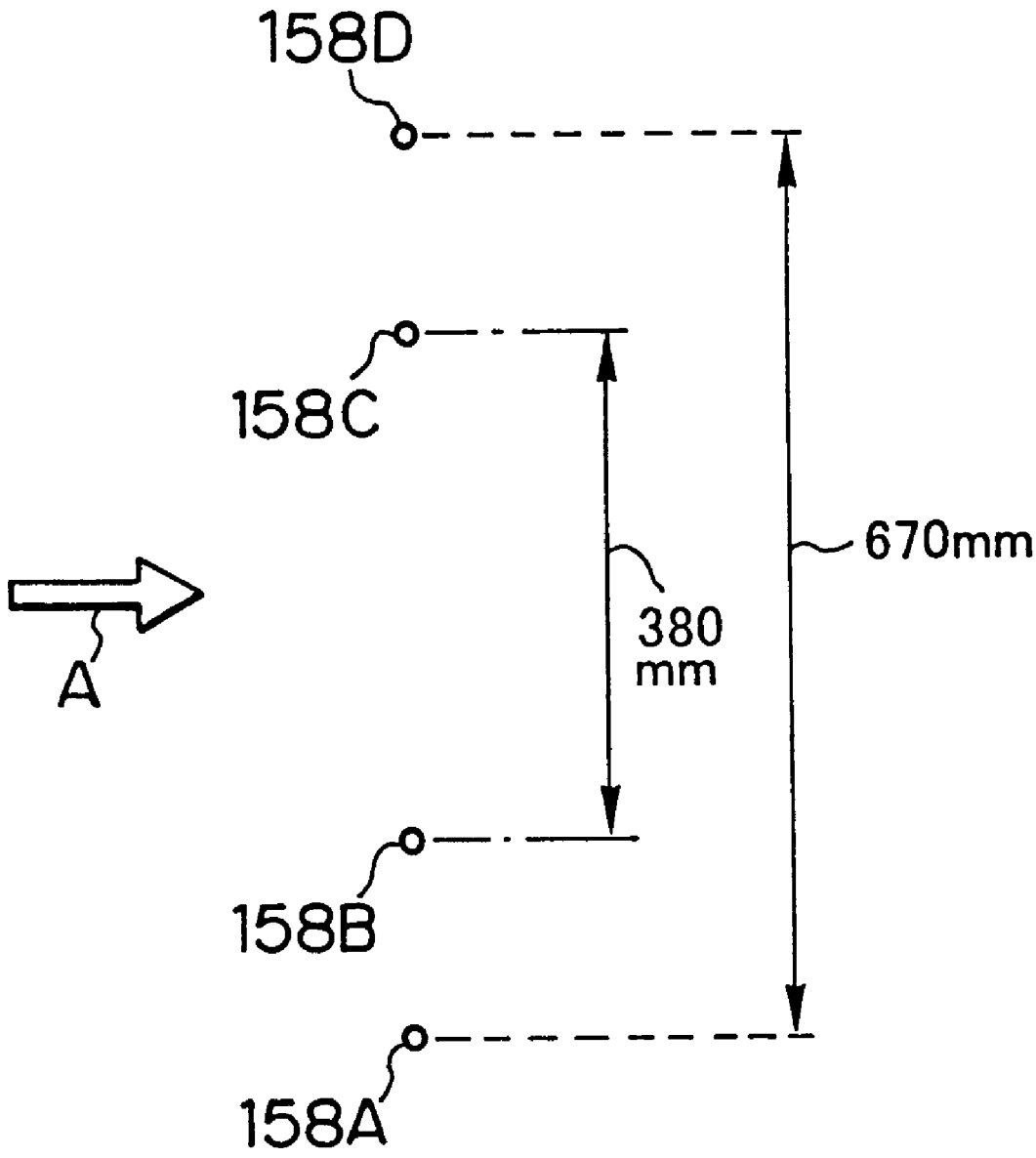
FIG. 8 is a plan view showing an arrangement structure of sensors for centering.

Arrangement structure of sensors 158 which are disposed in the vicinity of the surface plate 110 is shown in FIG. 8. If the direction in which the photopolymer plate 102 is conveyed from the photopolymer plate conveying portion 130 is direction A, the four sensors 158 (hereinafter, 158A, 158B, 158C and 158D respectively when referred to individually) are disposed along the direction which is orthogonal to the direction A.

These sensors are disposed so that the two inside sensors 158B and 158C have a pitch-size of 380 mm, and the two outside sensors 158A and 158D have a pitch-size of 670 mm. A central position between the sensors 158B and 158C coincides with a central position between the sensors 158A and 158D.

The sensors 158B and 158C serve as sensors for detecting an incline of the photopolymer plate 102 (with respect to the direction A). The sensor 158B is also used for detecting the position of the photopolymer plate 102 in the transverse direction of conveyance (in a direction which is orthogonal to the direction A), and the sensor 158C is only used for detecting the incline of the photopolymer plate 102.

Therefore, in practice, the three sensors 158A, 158B and 158D are applied for detecting the position of the photopolymer plate 102 in the transverse direction of conveyance.

(Positioning Control System Using Sensors)

Figure 9:
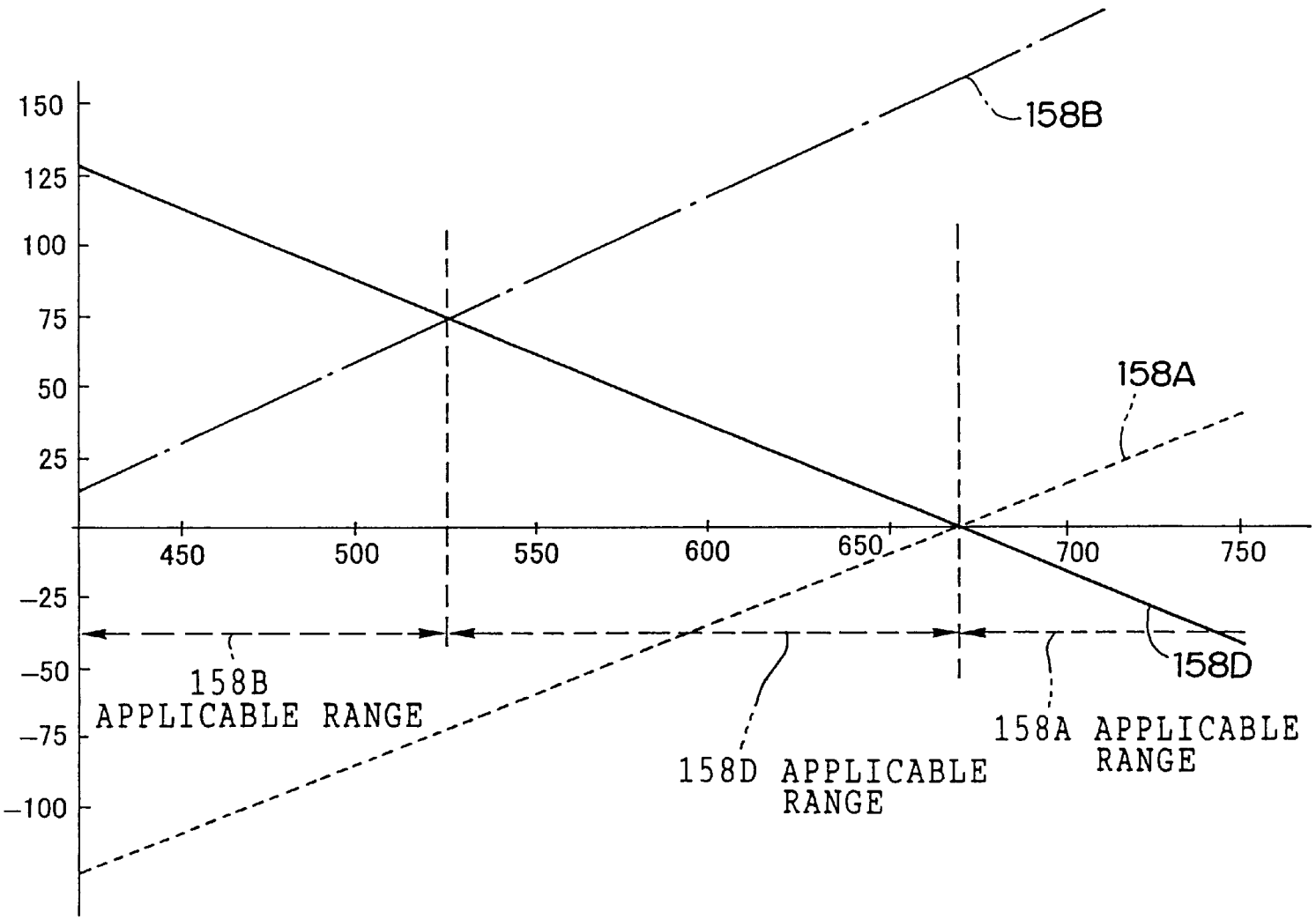
FIG. 9 is a characteristic chart showing relationships between sizes of the photopolymer plates and distances from each of the sensors to respective detected corners of each of the photopolymer plates.

FIG. 9 shows relationships between sizes of the photopolymer plates 102 having various sizes, and distances from respective detected corners of each of the photopolymer plates 102 to each of the sensors 158, when the photopolymer plates 102 are sent from the photopolymer plate conveying portion 130.

When the photopolymer plate 102 is moved in the transverse direction of conveyance, each of the sensors 158 switches from a photopolymer plate 102 detected state (On) to a photopolymer plate 102 undetected state (Off), or may switch from the undetected state (Off) to the detected state (On). In this embodiment, the corner of the photopolymer plate 102 is detected in the following situations:

1. for detection by the sensor 158A: when it is switched from On to Off;
2. for detection by the sensor 158B: when it is switched from On to Off; and
3. for detection by the sensor 158D: when it is switched from Off to On.

The above definitions are predetermined, and thereby, for example, even if the switching characteristics of the sensors include hysteresis or the like, corners of the photopolymer plates 102 can be accurately detected.

Figure 11:
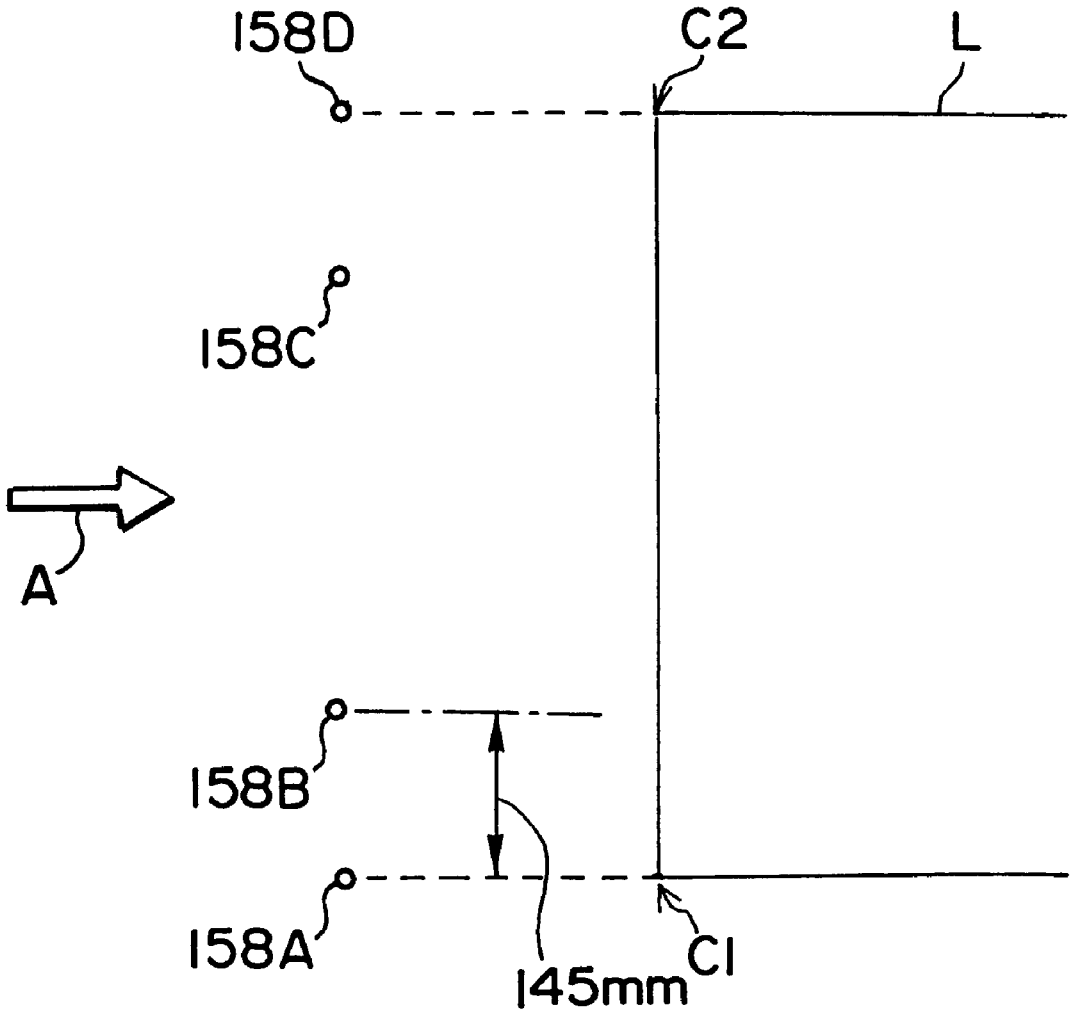
FIG. 11 is a plan view showing a positional relationship between the photopolymer plates and the sensors.

When the characteristics of each of the sensors 158 shown in FIG. 9 are looked at with the above definitions 1–3 in consideration, it can be seen that, in a case of the photopolymer plate 102 having a size ranging from 400 mm to 525 mm, the sensor 158B is closest to the detected corner of the photopolymer plate 102; in a case of a size ranging from 525 mm to 670 mm, the sensor 158D is closest thereto; and in a case of a size ranging from 670 mm to 740 mm, the sensor 158A is closest thereto. In FIG. 11, for example, in the case of the photopolymer plate L having a 670 mm size in the transverse direction of the conveyance, the distance between the corner C1 of the photopolymer plate L and the sensor 158A is zero, the distance between the corner C2 of the photopolymer plate L and the sensor 158D is zero, the distance between the corner C1 of the photopolymer plate L and the sensor 158B is +145 mm.

Figure 10:
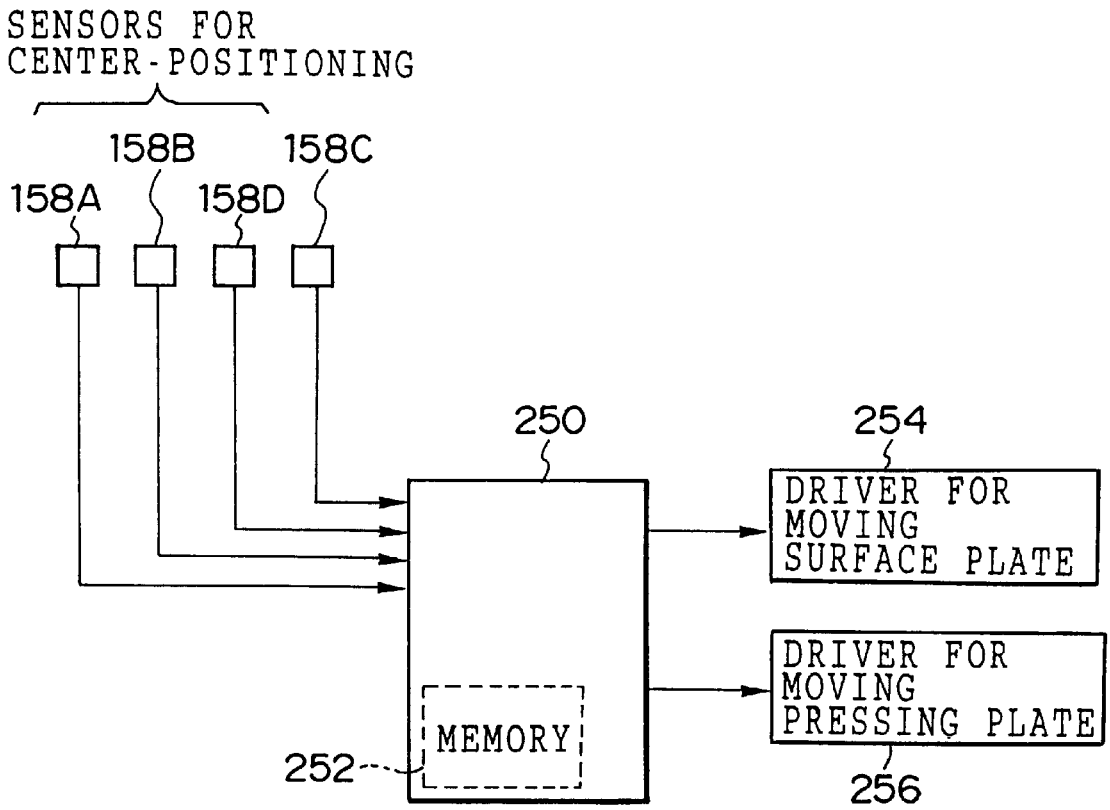
FIG. 10 is a control block diagram for centering the photopolymer plate.

In this embodiment, a controlling portion 250 for positioning, which is shown in FIG. 10, is provided with a memory 252, which stores in advance the size of the photopolymer plate 102 sent from the photopolymer plate conveying portion 130. In accordance with the size of the photopolymer plate 102 stored in the memory 252, the most suitable one of the sensors 158 (i.e., the sensor which is closest to the detected corner of the photopolymer plate 102) is selected in advance and applied. A driver 254 for moving the surface plate 110 and a driver 256 for moving the pressing plate 156 are connected to the controlling portion 250.

Hereinafter, operation of this embodiment will be described.

When the photopolymer plate 102 is sent from the photopolymer plate conveying portion 130 onto the surface plate 110, the photopolymer plate 102 is separated from the final conveying roller of the photopolymer plate conveying portion 130, and is loaded on the surface plate 110 such that it is slid down. Therefore, the position of the photopolymer plate 102, which has been slid down on the surface plate 110, relative to the surface plate 110 is irregular (different each time), and thus, an incline of the photopolymer plate 102 and the position of the photopolymer plate 102 in a direction which is along the conveying direction from the photopolymer plate conveying portion 130 are corrected first.

When the photopolymer plate 102 is discharged from the photopolymer plate conveying portion 130, the photopolymer plate 102 lands on the surface plate 110 in the state in which it hangs slightly, and the hanging portion of the photopolymer plate 102 is supported by the temporary support plate 154. In this state, the rear end portion of the photopolymer plate 102 is pressed by the pressing plate 156, and as a result, the incline of the photopolymer plate 102 with respect to the conveying direction of the photopolymer plate 102 is eliminated. Further, when the photopolymer plate 102 is pressed by a predetermined degree by the pressing plate 156, the photopolymer plate 102 can be sent to the predetermined reference position in the conveying direction. If the edge of the rear end portion of the photopolymer plate 102 in the conveying direction is detected by the sensors 158B and 158C, it can be recognized that the photopolymer plate 102 has been positioned at the suitable position. (When the sensors 158B and 158C detect the photopolymer plate 102 at the same time, it is judged that the photopolymer plate 102 is positioned at the predetermined reference position without incline.)

After the photopolymer plate 102 has been positioned at the reference position, the position of the photopolymer plate 102 in the transverse direction of conveyance is detected by using one of the sensors 158A, 158B and 158D.

In this case, in this embodiment, the size of the photopolymer plate 102 loaded on the surface plate 110, which size is stored in the memory 252 of the controlling portion 250 for positioning, is read out, and based on this size, the most suitable sensor is selected using a characteristic chart in FIG. 9. The most suitable sensor is a sensor, which clears the above-mentioned conditions 1–3 and which is closest to the detected corner of the photopolymer plate 102.

When the selected sensor (sensor 158A, 158B or 158D) detects the corner of the photopolymer plate 102 by movement of the surface plate 110 (by relative movement of the surface plate 110 and the photopolymer plate 102) in the transverse direction of conveyance, a punch-hole is formed in the photopolymer plate 102, and this position is registered as a start position at the time of exposing the photopolymer plate 102.

After that, exposure is started at the time when the surface plate 110 has moved by a predetermined amount from the start position to the exposure section 112.

As described above, in this embodiment, the sensor, which requires the smallest amount of movement for detecting the corner of the photopolymer plate 102, is selected from the three sensors 158A, 158B and 158D for centering the photopolymer plate 102 (for positioning the photopolymer plate 102 in the transverse direction of conveyance). As a result, positioning operation can be rapidly carried out, and the operation efficiency can be improved.

In this embodiment, the three sensors 158A, 158B and 158D are used for centering. However, if at least two sensors are disposed so that one of the sensors, which requires smaller amount of movement, is selected, the effect of the present invention can be obtained. Further, if four or more sensors are disposed, the amount of movement for positioning can be reduced even more.

Figure 12:
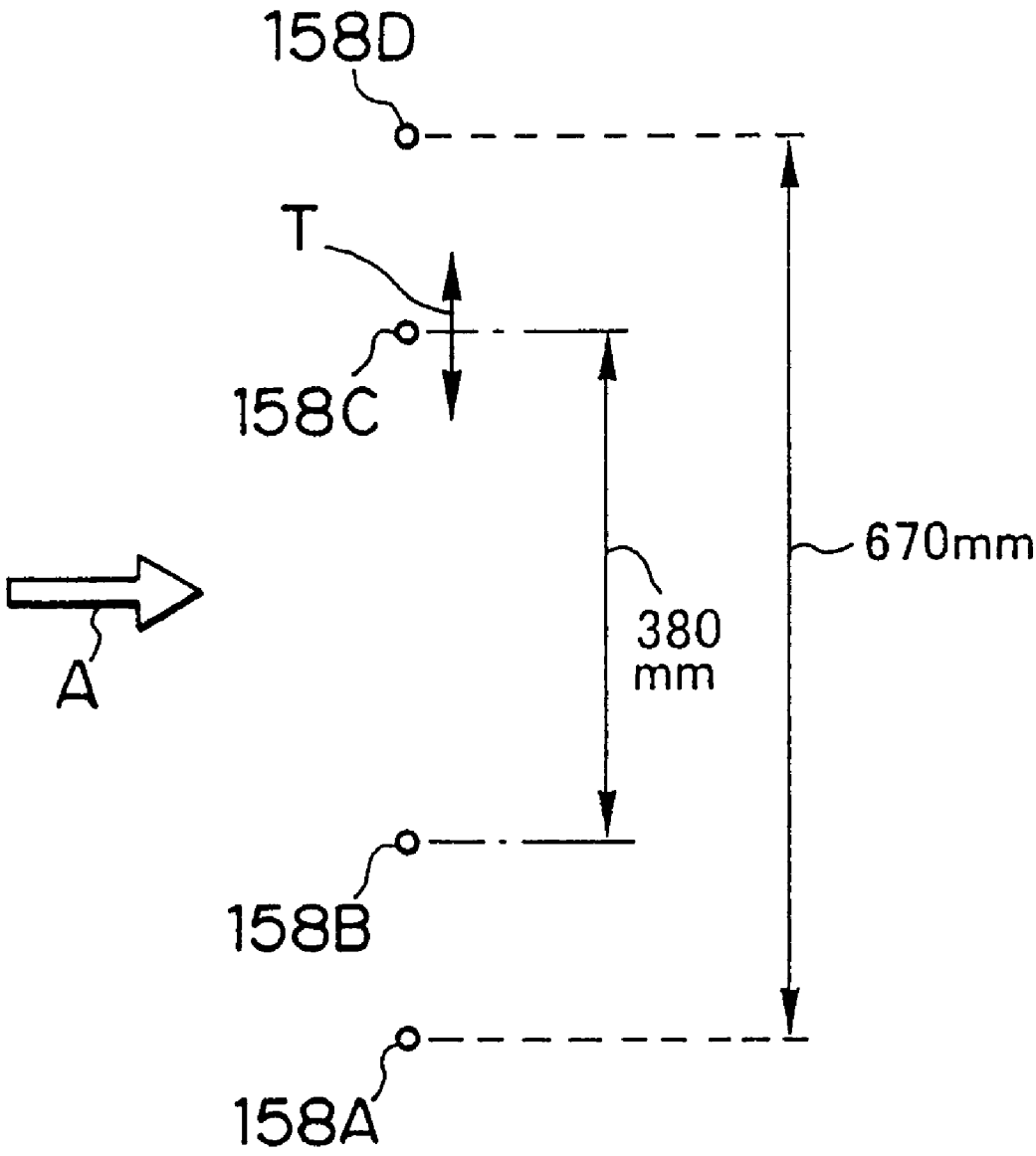
FIG. 12 is a plan view showing another arrangement structure of sensors for centering.

Furthermore, in this embodiment, the sensors 158A, 158B and 158D are fixed. However, at least one of the sensors (preferably, the sensor 158C locating in the middle) may be structured so as to move in the direction of movement for positioning (in the transverse direction of conveyance), so that the sensor can move to the most suitable position based on the size of the photopolymer plate 102, which size is stored in the memory 252. (In FIG. 12, the sensor 158C can move along a directions indicated by an arrow T.) Moreover, a large number of sensors may be closely arranged.

Each of the sensors 158A, 158B and 158D may be a linear CCD sensor, respectively.

As described above, the sheet material positioning method and apparatus relating to the present invention has superior effects that, at the time of positioning the sheet material, a small number of sensors can be used for positioning and the amount of movement for positioning can be minimized, and that, improvement of the operation and stabilization of the positioning accuracy can be achieved.

What is claimed is:

1. A sheet material positioning method, in which, sheet materials having a plurality of sizes are conveyed in a conveying direction so as to be loaded onto a surface plate, the method comprising:

(a) loading a sheet material onto the surface plate;

(b) removing an incline of the sheet material on the surface plate relative to the conveying direction;

(c) moving the sheet material relative to the surface plate to a first predetermined position in the conveying direction;

(d) moving the sheet material together with the surface plate in a direction orthogonal to the conveying direction, such that the sheet material is positioned at a second predetermined position;

(e) recognizing at least one dimension of the sheet material in the direction orthogonal to the conveying direction before step (d);

(f) selecting a sensor from a plurality of sensors, the selected sensor being closest to at least one corner of the sheet material based on the recognized dimension of the sheet material; and (g) detecting the corner of the sheet material by the selected sensor.

2. A sheet material positioning method according to claim 1, wherein steps (b) and (c) are performed simultaneously by a pressing member, which has a portion that is orthogonal to the conveying direction, pressing the sheet material to the first predetermined position.

3. A sheet material positioning method according to claim 1, wherein the dimension of the sheet material in the direction orthogonal to the conveying direction has different values, the different values are on the basis of a predetermined dimension of 10 mm or lower.

4. A sheet material positioning apparatus, in which, sheet materials having a plurality of sizes are conveyed in a predetermined conveying direction so as to be loaded onto a surface plate, said apparatus comprising:

a correcting device, which (1) removes an incline of the sheet material on the surface plate relative to the conveying direction, and (2) moves the sheet material relative to the surface plate to a first predetermined position in the conveying direction;

a plurality of sensors, which detect at least one corner of the sheet material by movement of the sheet material in a direction orthogonal to the conveying direction;

a storing device, which stores at least one dimension of the sheet material in the direction orthogonal to the conveying direction;

a selecting device, which, based on the dimension stored in said storing device, selects a sensor from said plurality of sensors, the selected sensor being closest to the at least one corner of the sheet material for positioning the sheet material at a second predetermined position; and a movement controlling device, which moves the sheet material in the direction orthogonal to the conveying direction based on the sensor selected by said selecting device, and which stops the movement of the sheet material at the second predetermined position when the selected sensor has detected the at least one corner of the sheet material.

5. A sheet material positioning apparatus according to claim 4, wherein, said correcting device is a pressing member, which has a portion that is orthogonal to the conveying direction, and wherein, after the sheet material has been loaded onto the surface plate, the pressing member presses the sheet material to the first predetermined position.

6. A sheet material positioning apparatus according to claim 4, wherein the dimension of the sheet material in the direction orthogonal to the conveying direction has different values, the different values are on the basis of a predetermined dimension of 10 mm or lower.

7. A sheet material positioning apparatus according to claim 4, wherein said plurality of sensors include two sensors, which are disposed at positions corresponding to dimensions of smallest and largest sheet materials in the direction orthogonal to the conveying direction.

8. A sheet material positioning apparatus according to claim 4, wherein said plurality of sensors include three sensors, two sensors of which are disposed at positions corresponding to dimensions of smallest and largest sheet materials in the direction orthogonal to the conveying direction, and one sensor other than said two sensors is disposed at a position in substantially a middle of said two sensors.

9. A sheet material positioning apparatus according to claim 4, wherein said plurality of sensors include CCD line sensors.

10. A sheet material positioning apparatus according to claim 4, wherein the sheet material is a printing plate in which a photosensitive layer is provided on a support.

11. A sheet material positioning apparatus according to claim 10, further comprising a puncher for forming a punch-hole, for positioning the printing plate at a mounting position on a printing drum, in the printing plate.

12. A sheet material positioning method, in which, a sheet material is conveyed in a predetermined conveying direction so as to be loaded onto a surface plate, and the sheet material loaded onto the surface plate is moved in a direction orthogonal to the conveying direction, such that the sheet material is positioned at a predetermined position on the surface plate by a plurality of sensors for detecting the sheet material, the method comprising:

recognizing at least one dimension of the sheet material in the direction orthogonal to the conveying direction;

selecting a sensor, from the plurality of sensors, which is closest to at least one corner of the sheet material for positioning the sheet material at the predetermined position, wherein the selection is based on the recognized dimension of the sheet material; and detecting the sheet material by the selected sensor.

13. A sheet material positioning method according to claim 12, further comprising:

correcting the orientation and position of the sheet material so that the sheet material has a predetermined orientation with respect to the conveying direction and the sheet material is positioned at a predetermined position in the conveying direction.

14. A sheet material positioning method according to claim 12, wherein the corner of the sheet material is detected by the selected sensor.

15. A sheet material positioning apparatus, in which, a sheet material is conveyed in a predetermined conveying direction so as to be loaded onto a surface plate, and the sheet material loaded onto the surface plate is moved in a direction orthogonal to the conveying direction, such that the sheet material is positioned at a predetermined position on the surface plate by a plurality of sensors for detecting the sheet material, said apparatus comprising:

a recognizing portion, which recognizes at least one dimension of the sheet material in the direction orthogonal to the conveying direction; and a selecting portion, which, based on the dimension of the sheet material recognized by said recognizing portion, selects a sensor from the plurality of sensors, the selected sensor being closest to at least one corner of the sheet material for positioning the sheet material at the predetermined position;

wherein the sheet material is detected by the selected sensor.

16. A sheet material positioning apparatus according to claim 15, wherein the corner of the sheet material is detected by the selected sensor.

17. A sheet material positioning apparatus according to claim 15 further comprising a storing device, which stores the dimension of the sheet material recognized by said recognizing portion.

* * * * *